US005819890A

United States Patent [19]

Lin

[11] Patent Number: 5,819,890

[45] Date of Patent: Oct. 13, 1998

[54] RIGID FRAME GARMENT BAG

[75] Inventor: Shin-Fu Lin, Taipei, Taiwan

[73] Assignee: Paragon Luggage, Inc., Tustin, Calif.

[21] Appl. No.: 796,657

[22] Filed: Feb. 5, 1997

[51] Int. Cl.[6] ..... A45C 5/14; A45C 13/04; A45C 13/10; A45C 13/36

[52] U.S. Cl. ..... 190/18 A; 190/113; 190/119; 190/122; 206/287.1

[58] Field of Search ..... 190/122, 127, 190/903, 113, 119, 120, 121, 18 A; 206/287.1, 279, 287; 388/97

[56] References Cited

U.S. PATENT DOCUMENTS

| | | | |
|---|---|---|---|
| 2,453,663 | 11/1948 | Hinson | 206/287.1 X |
| 2,717,671 | 9/1955 | Arnold et al. | 206/287.1 X |
| 2,985,266 | 5/1961 | Pelavin | 206/287.1 X |
| 3,104,740 | 9/1963 | Koffler | 206/287.1 X |
| 3,933,229 | 1/1976 | Pelavin | 206/287.1 |
| 4,738,360 | 4/1988 | King et al. | 206/287.1 X |
| 4,753,342 | 6/1988 | Pulichino, Jr. et al. | 206/287.1 X |
| 4,998,603 | 3/1991 | Nordstrom | 206/287.1 X |
| 5,113,982 | 5/1992 | Pulichino et al. | 206/287.1 X |
| 5,375,685 | 12/1994 | Plath | 206/287.1 X |
| 5,628,397 | 5/1997 | Ham | 206/287.1 X |
| 5,645,146 | 7/1997 | Bieber et al. | 190/127 X |

FOREIGN PATENT DOCUMENTS

| | | | |
|---|---|---|---|
| 4314401 | 11/1992 | Japan | 190/122 |
| 2076646 | 12/1981 | United Kingdom | 190/122 |

*Primary Examiner*—Sue A. Weaver
*Attorney, Agent, or Firm*—Jack A. Kanz

[57] ABSTRACT

A rigid frame garment bag travel case combination is formed in a rectilinear shaped case having opposed openable main compartments which share a common side. Each compartment is bounded by a partial rigid U-shaped frame. Between the openable compartments is a common wall provided with a separate planar frame which protects garments, especially suits or dresses, which may be hung from one compartment across the common side and into the other main compartment and secured by crossing straps. A small fold-out fabric panel attached to the lower edge of a lower main compartment is capable of holding dresses which are longer than both compartments. A larger fold-out panel is attached to one side of both main compartments and has a number of pockets for soft garments. The larger panel is folded over the openable compartments and the smaller panel. It is secured along its edge with a zipper. An additional external compartment is attached to one external side face and an additional second compartment is attached to the opposite external side face. The additional compartment includes exposed wheels and an extendable handle to permit rolling the closed case without lifting and has considerable space within. Multiple accessible pockets are provided for soft garments without opening the case. The rigid frame bag may be hung like a garment bag for loading and unloading of suits and dresses without dumping the soft garments contained in the multitude of pockets.

8 Claims, 3 Drawing Sheets

RIGID FRAME GARMENT BAG

This invention relates to foldable fabric garment bags. More particularly, it relates to rigid frame bags especially suited for preventing lasting creases in suits or dresses while providing sufficient space for soft garments.

BACKGROUND OF THE INVENTION

Travelers have a need to carry suits, dresses and other fine clothing garments. This type of clothing is normally stored on hangers because it is subject to wrinkling and crumpling when folded to fit into a conventional suitcase. A full length garment bag is the most effective way to prevent wrinkling of hanging clothes, but is not suitable for carrying anything other than hanging clothing. Even for trips of short duration, a traveler has an extra bag to carry in addition to the items normally carried in a suitcase. Although some folding garment bags are now provided with compartments for underwear, socks and other articles of clothing and have become relatively popular, they tend to be bulky and unwieldy and are not conveniently stowable beneath the seat or in the overhead compartment of an aircraft.

Attempts to modify suitcases to include hooks for hangers for such garments represent a compromise which has not been entirely successful. Hangers for holding coat hangers on at least one interior wall of a hard-sided relatively large suitcase so that suits, dresses and the like can be stored on a hanger, folded once, have not provided wrinkle-free transportation of fine articles of clothing and they are not suitable for carry-on. The pressing down of other articles in such suitcases, especially if the suitcase is relatively full, still results in crumpling and wrinkling of the hanging clothing.

Other suitcases have a panel with a thick wire frame on the perimeter for laying on top of the portion of hanging clothing which lays within the interior well of one side of a suitcase. Clothes which hang below the lower edge of such a panel are folded over the wire edge of the panel and then other clothing may be inserted. While the proper arrangement using such suitcases can lead to top and bottom portions of the hanging clothes which are relatively uncrumpled, experience shows that such an arrangement tends to put a crumpled crease in the clothing at which it is folded about the wire of the panel or simply folded on top of itself. An improved version of this folding panel arrangement is shown in U.S. Pat. No. 5,458,239 to Plath in which the use of a folding panel is accompanied by larger diameter padded bars at the fold line on a folding panel. This structure requires two folds in a suit and puts the entire folded assembly into the lid of the case. The folds in this structure are severe, however, despite the enlarged radius padded bars and any wrinkles where the suitcoat wraps the bars tend to get "ironed" in. Thus, the problem of transporting suits or dresses in wrinkle-free condition in a rigid frame stowable case which acts like a garment bag remains to be solved. The problem is compounded if several such garments are placed in such a case, one over the other. The prior art cases are not designed to hang for loading and unloading without unloading the contents.

SUMMARY OF THE INVENTION

The present invention provides a rigid frame garment bag and travel case combination which acts like a garment bag to prevent wrinkling and crumpling of suits, dresses and other fine garments. The structure of the invention is especially suitable for handling several business suits or other garments without significant wrinkling while still retaining the characteristics of ordinary roll-along luggage. The inventive structure provides a significant amount of space for other soft garments for short trips and is small enough to fit into an overhead compartment as required by airline rules.

The preferred embodiment is a rectilinear case with opposed openable main compartments foldingly and flexibly hinged along one common side. There is an upper compartment and a lower compartment viewed as the case is opened and laid out. The compartments are defined by a closed face, an open face into which the garments are placed and three generally rectangular sides in addition to the common side. The three rectangular shaped sides of the compartments have edges which come together along a common parting line closable with a sliding fastener when the compartments are pivoted toward each other about the foldingly hinged common side to close and form the case. When viewed from above with the case open and laying flat, an upper side and right angularly continuing opposed left and right sides comprise the upper compartment. A lower side, right angularly continuing into opposed left and right sides comprise the lower compartment. Each of the compartments has a rigid U-shaped frame which extends across the upper side of the upper compartment and another rigid U-shaped frame which extends across the lower side of the lower compartment. The U-shaped frames have legs which extend toward but short of the common wall along the left and right sides of the respective compartments. At least one brace lies across the closed face of the upper compartment and connects the ends of the legs of the rigid frame. Similarly, at least one brace lies across the closed face of the lower compartment and connects the ends of the legs which extend along and define the left and right sides of the lower compartment. Layers of fabric which make up the bag cover the U-shaped frames which lie in the interior of the sides under the fabric.

A planar frame forms part of the common wall between the upper and lower compartments and acts as the backbone of the common wall extending substantially between the left and right sides of the main compartments. The planar frame is covered with sturdy fabric from which the faces of the compartments are formed. The common wall has an upper edge portion and a lower edge portion when considered in the flat laid open orientation of the case wherein the upper edge portion serves as a loose hinged connection to the upper compartment and the lower edge portion serves as a loose hinged connection to the lower compartment. The upper and lower edge portions extend away from and are separated by the height of the planar frame. The common wall has an interior surface facing up when the case is open and the closed faces of the main compartments are on a surface. A securable strap extends between the left and right sides along the interior surface of the common wall over the planar frame in order to hold a suit or several suits against the common wall, thereby establishing a soft fold protected by the common wall when the case is closed.

In addition, a large foldable panel has an edge foldably connected along one of the side edges of both the upper and lower compartments. As the panel has an outer periphery slightly less than the combined periphery of the upper and lower compartments, it may be pivoted like the page of a book over the open faces of both compartments and removably fastened therein to serve as a flexible wall over garments previously placed in the compartments. The upper side has a centrally located hanger fastening device to hold hangers whereby a suit or several suits can be laid out flat across the upper and lower compartments and the common wall and covered with the folding panel to create a soft fold in the vicinity of the common side when the case is closed and secured, thereby preventing hard wrinkles from forming. In addition to the strap which lies over the interior surface of the common wall to hold such suit or suits in place, other straps may be placed across the suits to hold them against the closed faces of the upper and lower compartments.

Preferably a further folding panel having an edge connected along the lower side and an area substantially equal to the open area of the lower compartment can be folded over the open face of the lower compartment and secured to form a removable wall over the lower compartment before the larger panel is folded over the open face of both compartments. Both of these flexible panels preferably include several accessible pockets for soft garments such as shirts, underwear, socks, etc.

The lower compartment preferably includes an additional compartment mounted on the outside closed face of the lower compartment. The additional compartment is substantially coextensive with the lower compartment, has a perimeter wall defined by a rigid frame and includes exposed wheels attached to the frame and a handle suitable for rolling the closed case along a surface without lifting the full weight of the case. The additional compartment attached to the lower main compartment is traversed internally by an extendable handle mechanism connected to an extendable handle opposite the wheels and having an openable access opening for storage of soft garments within the additional compartment.

The closed face of the upper compartment preferably includes a second additional compartment mounted on the outside of the closed face of the upper compartment. The second additional compartment is substantially coextensive with the upper compartment, having a flexible outer wall surface accessible from the outside of the closed case and one or more pockets having closures for storage of soft garments. Because the closed faces of the upper and lower compartments and the additional and second additional compartments are made of flexible material, they will expand outwardly when stuffed with soft garments without putting firm pressure on the once folded suit or suits, for example, contained within the main compartments of the structure. Since the peripheral walls of the closed case which are referred to as upper and lower sides and right and left sides are defined by a rigid frame with a width substantially coextensive with the width direction of the sides, the contents are protected from crushing if the case if offered for baggage and not carried on.

Even with two suits in the case, there is still sufficient room in the main compartments for additional soft garments such as shirts and underwear. The case of the invention can be hung by handle or hook for convenient loading of hangered shirts or dresses without stooping. Soft garments can be stowed in the multitude of separate pockets. The hangered garments are placed with the aid of gravity so they hang naturally. Once the larger folding panel is closed over the hangered garments, they are held in the correct position which is established while the case is hanging. The larger folding panel and the smaller folding panel hold the suits or dresses in place when the case is closed. Upon reaching the destination, the traveler can actually open the case and hang it by a handle just like a garment bag, if desired, without unloading the soft garments because they can remain in the multitude of separate pockets. Other features and advantages will become apparent from the following description taken in connection with the appended claims and attached drawing in which:

DESCRIPTION OF THE PREFERRED EMBODIMENTS

Figure 1:
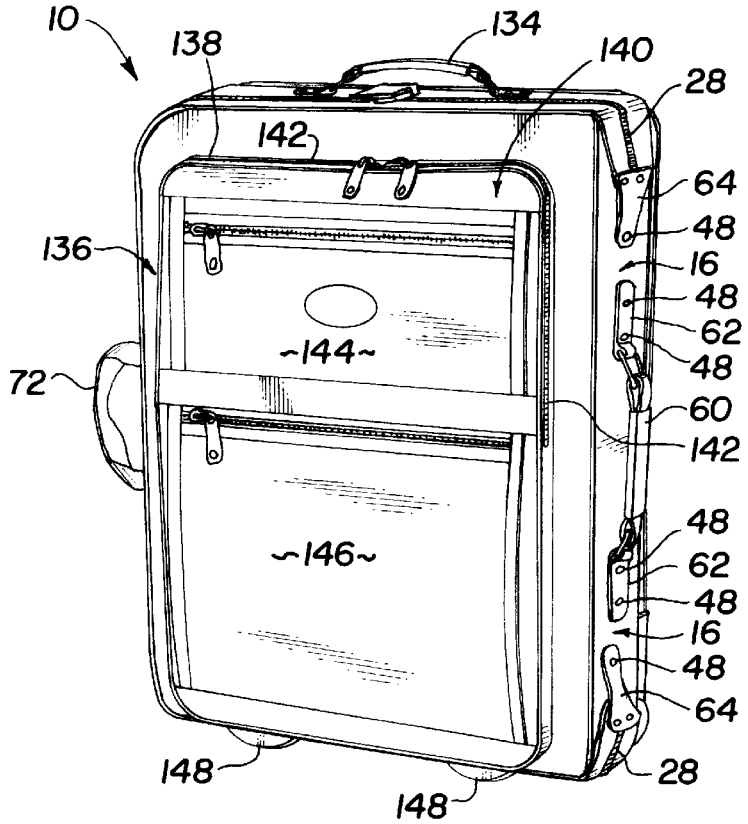
FIG. 1 is a perspective view showing the second additional compartment on the closed face of the upper main compartment.

Throughout the drawing, the rigid frame garment bag travel case combination is referred to generally by the reference numeral 10. FIG. 1 shows what may be regarded as the front of case 10 while FIG. 2 may be regarded as a view of the back of case 10. Like parts are given the same reference numerals throughout the drawing.

Figure 3:
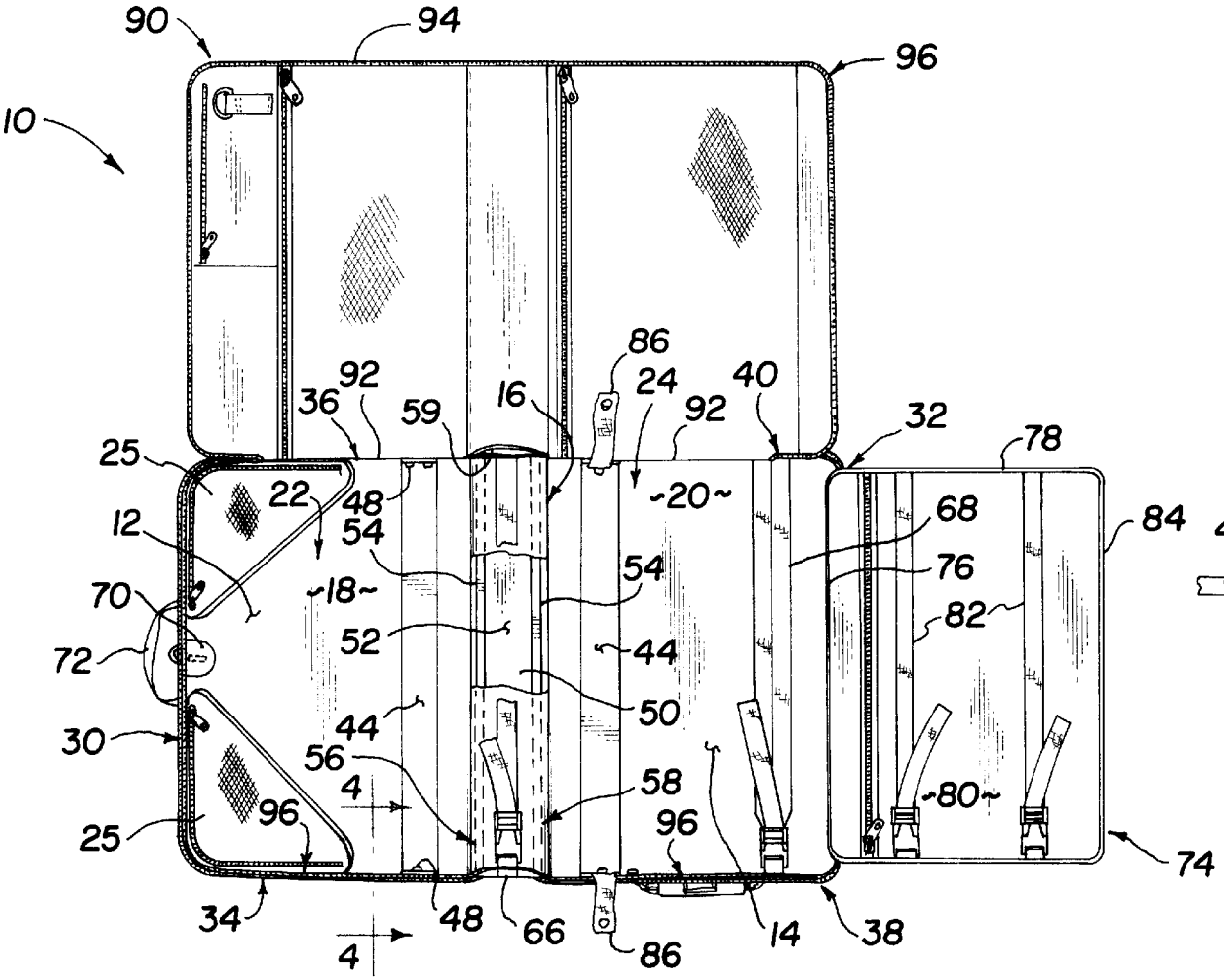
FIG. 3 is a plan view of the case in its full open and laid out position over a flat surface wherein a flexible panel having an edge connected along the right side of both upper and lower main compartments and another panel having an edge connected along the lower side of the lower compartment are laid open respectively to the right of and below the main compartments.

As illustrated in FIG. 3, case 10 is opened up and laid flat on a surface. Most of the description will be given in reference to this orientation of the fully opened case 10. Case 10 has opposed openable main compartments comprising an upper compartment 12 and a lower compartment 14 foldingly hinged along the common side 16. The main compartments 12, 14 are defined by faces in the plane of the drawing sheet and sides which, except for the common side, are perpendicular to the plane of the sheet. Upper compartment 12 has a closed face 18 and lower compartment 14 has a closed face 20. The closed faces are, of course, attached to the sides and form a floor of the main compartments 12 and 14. Directly above and coextensive with the closed faces 18 and 20 are corresponding open faces 22 for the upper compartment and 24 for the lower compartment. These open faces come together when the hingedly connected compartments are pivoted to face each other when case 10 is closed. Removable zippered pockets 25 are conveniently located at the upper corners of compartment 12.

Figure 6:
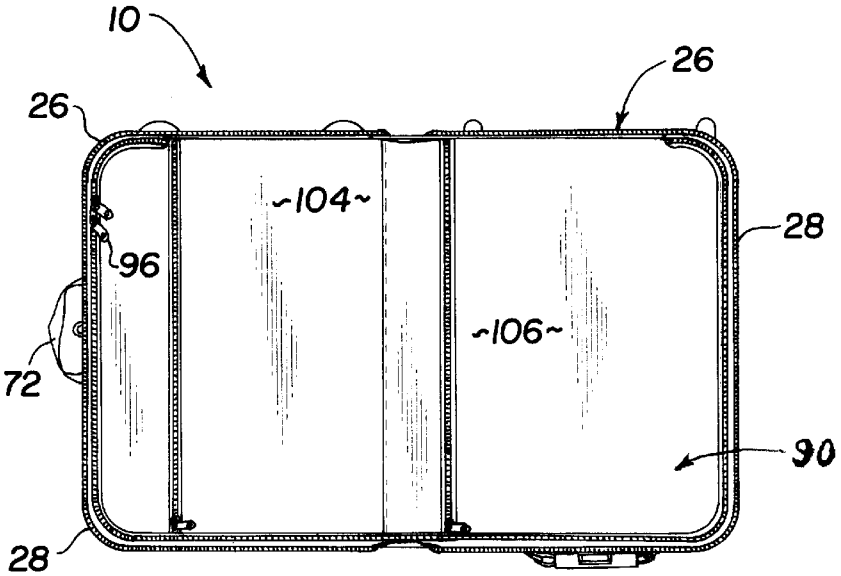
FIG. 6 shows the next step in closing the case after the steps shown in FIG. 5 in which the larger panel attached along the right side of both compartments is folded over and secured and showing that the folding panel has accessible pockets on both surfaces.

The compartments have three generally rectangular sides in addition to the common side 16 which come together along a common parting line 26 best seen in FIG. 6. Parting line 26 comprises both sides of a sliding fastener 28 located at the upper edge of the sides which surround the compartments and which is used to close case 10.

Returning to FIG. 3, the upper compartment has an upper compartment 30 and the lower side has a corresponding lower side 32 which is partly obscured by a small flap or panel to be described later. Upper side 30 continues smoothly into the left side 34 and a right side 36 which in FIG. 3 is partly obscured by a large flap or panel to be described later. Similarly, the lower side 32 of lower compartment 14 transitions smoothly into a left side 38 and a right side 40 which is partially obscured by the large flap or panel mentioned above.

Figure 4:
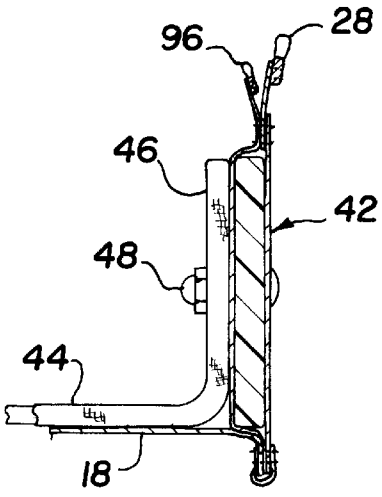
FIG. 4 is a cross-sectional view along the line 4—4 of FIG. 3 showing a portion of the U-shaped frame where it is fastened to a brace laying across the closed face of the upper compartment.

Sides 30, 34 and 36 and sides 32, 38 and 40 are each made of two layers of material sandwiching a rigid frame 42 which is seen in FIG. 4. Frame 42 is preferably a light-weight rigid plastic which has some flexibility to withstand abuse. The three rectangular shaped sides of each compartments 12, 14 have a frame 42 in the form of a rigid U-shaped frame contained within fabric walls as indicated in FIG. 4. With respect to upper compartment 12, frame 42 extends across the upper side 30, having legs which extend along each of the left side 34 and right side 36 but end short of the common side 16. The legs of the rigid U-shape frame in upper compartment 12 extend to approximately where a brace 44 is seen in FIG. 3. Brace 44 is a flat rectangular shaped piece with upturned right angled ends 46 which by means of a fastener 48 connect the ends of the legs of rigid U-shaped frame 42 in upper compartment 12 and secures them. Brace 44 is preferably covered with fabric.

Lower compartment 14 has sides supported by a rigid U-shaped frame 42 in exactly the same manner as does upper compartment 12. In lower compartment 14, frame 42 runs along lower side 32 with legs turning at right angles to form the interior of the left side 38 and right side 40, terminating where another brace 44 connects the ends of the legs of the U-shaped frame and secures them short of common wall 16.

When case 10 is closed, common side 16 forms part of the fourth side of upper compartment 12 and the fourth side of lower compartment 14. A planar frame 50 sandwiched between fabric panels which make up common side 16 extends along common side 16 from the left side to the right side of case 10. Planar frame 50 preferably comprises a main planar member 52 which is conveniently made from the same thickness and type of material as rigid frame 42. Frame 50 preferably includes a thinner flexible member 54 lying under planar member 52 in FIG. 3 which is wider than member 52 and extends a small distance above and below the top and bottom edges of main planar member 52.

Common side 16 has an upper edge portion 56 and a lower edge portion 58 where the doubled fabric panels covering planar frame 52 extend away from the frame and are loosely and flexibly coupled to the fabric which forms the closed faces of compartments 12 and 14. The fabric may simply be continued across the common side in a double piece between which planar frame 50 is located. In the preferred embodiment, the thinner flexible member 54 may be extended left and right slightly beyond main planar member 52 and sewed along the edge 59 to hold it in place. Other conventional means could be employed to keep planar frame 50 in place so that it acts as a backbone of the common side to which handles or straps may be anchored from outside the case by means of bolts through the planar members and the fabric.

Edge 59 represents the opposite ends of common side 16 generally in line with the left and right sides of the main compartment but is not connected to them except through the connection of the common wall along the upper and lower edge portions of common side 16 which comprise the loosely hinged fabric connections. This allows the common side to lie relatively flat when the case is laid out fully opened on a surface.

In FIG. 1, the common side 16 is shown on the right side where handle 60 is bolted in place through the planar member at tabs 62 with fasteners 48. Tabs 64 near the ends of common wall 16 are also bolted through planar member 50. Tabs 64 anchor the ends of sliding fastener 28 which forms the parting line 26 seen in FIG. 6.

Common wall 16 is seen in FIG. 3 showing an interior surface over planar frame 52. A securable strap 66 with connections at the left and right side lays along the interior surface of common wall 16 and serves to hold a suit against the common wall thereby helping to establish a soft fold line at common wall 16 when case 10 is closed. An additional securable strap 68 is seen lying across the interior side of closed face 20 of lower compartment 14. Additional straps may be employed as desired. Fixed elastic straps could be employed.

Figure 5:
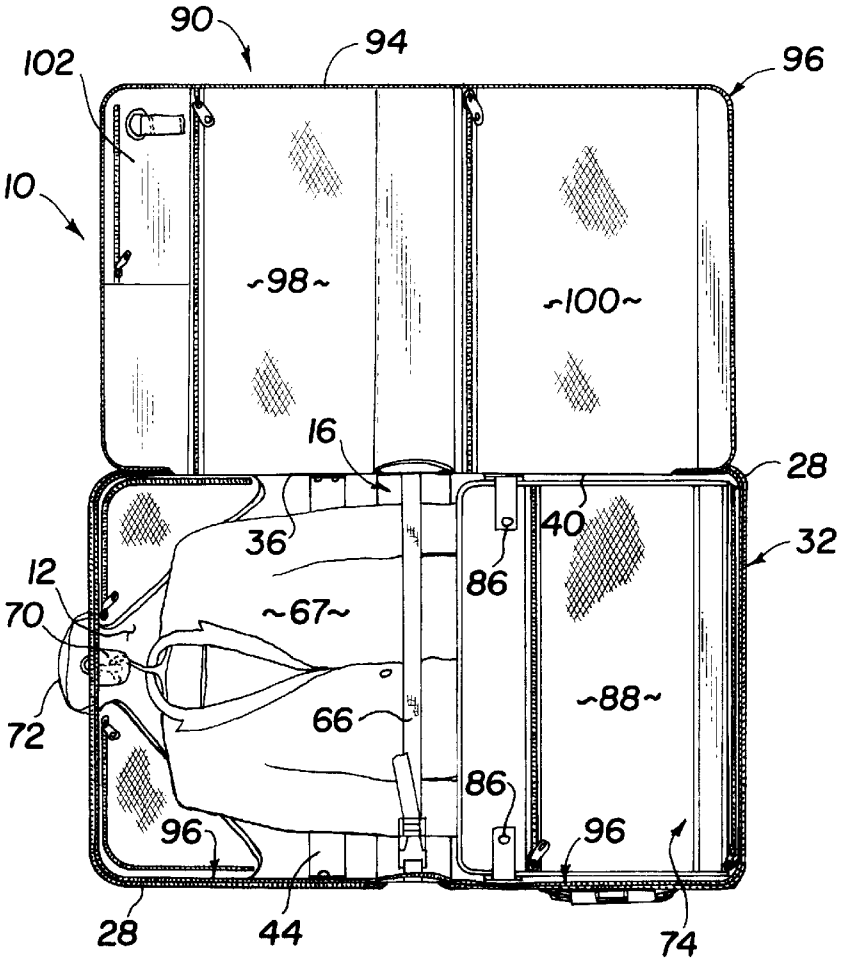
FIG. 5 is a view similar to FIG. 3 after a suit has been hung and secured in the middle with a holding strap fastened over the common side and the smaller of the folding panels folded inwardly over the lower main compartment and the lower portion of the suit contained therein.

Normally a suit coat 67 in FIG. 5 when hung from fixture 70 near handle 72 along the upper side of compartment 12 will hang straight across both open compartments to near lower side 32. The structure is ideally suited to carrying several suits 67 on top of each other in this manner because the height of the sides above closed faces 18, 20 will easily accommodate several suits with space remaining. When the case is closed there is a large radius soft fold line established along common side 16 which is protected by the width of the planar member 52. In the preferred embodiment, the planar member 52 is about 3¼ inches wide and the thinner planar member 54 is about 4¾ inches wide, although these dimensions are not critical. Handle 72 may be a hook (not shown) or a separate hook may be provided to provide a means for hanging the rigid frame bag in a vertical orientation for loading and unloading.

A small flexible flap or panel 74 is flexibly attached along one edge near the upper inside edge of lower side 32. This will be referred to as the smaller panel 74. The edge 76 is connected to lower side 32. A perimeter 78 having a cloth covered wire frame therearound establishes a rectangular area substantially equal to the open area of open face 24 of the lower main compartment. The wire frame simply holds the shape and makes the panel easy to open and close, but it is not essential. The panel preferably includes an accessible pocket 80 on the inner surface and may contain one or more securing straps 82 which may be used to secure a garment. This flap is of particular use in the case of long dresses which will extend below lower side 32 but in most cases will not extend below the lower edge 84 of smaller panel 74. After placing suits or dresses on hangers and securing them in place with straps 66, 68 and 82, panel 74 is folded over as shown in FIG. 5 and attached by means of straps 86 to hold it in place. Because edge 76 is attached near the upper edge of lower side 32 of compartment 14, there is another soft fold created there which is protected by the height of lower side 32 above closed face 20 even if the hanging garment extends out onto panel 74. The case can be opened and hung up vertically by handle 72. The suits or dresses can be placed on hangers and put into the hanging open case. It is noted in FIG. 5 that an additional accessible pocket 88 is conveniently provided on the opposite side of panel 74 from pocket 80. In the preferred embodiment, smaller panel 74 is a flexible fabric panel loosely hinged at lower side 32.

Returning to FIG. 3, there is a larger foldable panel 90 having an edge 92 foldably connected to the upper portion of the inside surfaces of the side edges 36, 40 of the upper and lower compartments. The rectangular perimeter edge 94 of panel 90 is slightly less than the combined periphery of the upper and lower compartments and includes a sliding fastener 96 around three sides of perimeter 94. A cooperating corresponding portion of zipper 96 is found attached to the sides just inside zipper 28 in FIG. 6. It will be noted that the inside surface of larger panel 90 includes a pair of accessible panels 98 and 100. These are suitable for shirts or other soft garments. An additional pocket 102 for small items is seen in the upper right hand corner of FIG. 5. FIG. 6 shows the appearance of the opposite side of larger panel 90 after it has been folded over coat 67 to close the open faces 22, 24 of both compartments and overlap smaller panel 74 where it is fastened in place by means of sliding fastener 96. It will be noted that there are additional pockets 104 and 106 on the underside of larger panel 90 in FIG. 5, which are seen in FIG. 6. In the preferred embodiment, larger panel 90 is a flexible fabric panel loosely hinged along sides 36 and 40 but unconnected to common side 16.

Figure 2:
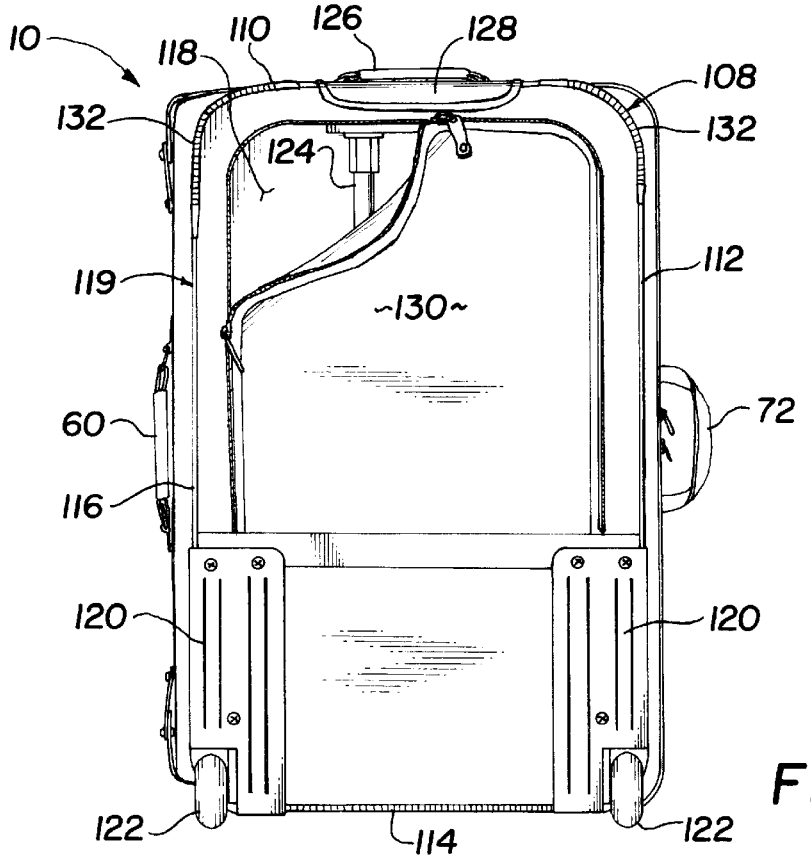
FIG. 2 is a view from the opposite side of FIG. 1 showing the additional compartment mounted on the closed face of the lower main compartment and an access area containing a telescoping handle mechanism which enables the case to be rolled.

FIG. 2 shows an additional compartment 108 mounted on closed face 20 of the lower compartment. Additional compartment 108 has rectilinear sides 110, 112, 114, 116 perpendicular to face 20 which enclose a chamber 118. Sides 110, 112, 114, 116 form a perimeter wall defined by an internal frame similar to frame 42. The frame is hidden in FIG. 2 but follows along and forms the shape of contiguous sides 110–116. A pair of opposed wheel mounts 120 have exposed wheels 122 located near side 114. The wheel mounts are rigidly attached to the internal frame 119. Chamber 118 of compartment 108 is traversed internally by an extendable handle mechanism 124 and an extendable handle 126 of a conventional nature. The handle 126 is disposed in a well formed within frame 119 and covered with a flap 128. Additional compartment 108 has an openable access panel 130 which is closed with a zipper. Despite the presence of handle mechanism 124, a considerable amount of soft garments can be stored within chamber 118 without disturbing or opening the main case. Chamber 118 is ideal for storing soiled clothing. Frame 119 in FIG. 2 is a rigid frame separate from the frame in the main compartment below. Additional compartment 108 is connected to the remainder of the bag mainly through the fabric sidewalls which tie into the rest of the bag. Protective corner welts 132 are used in places to resist wear. The wheel structure is described in detail in my copending U.S. patent application Ser. No. 08/744,466 filed Nov. 7, 1996 which is incorporated herein by reference. As seen in FIG. 1, an additional handle 134 not seen in FIG. 2 may be placed in the vicinity of handle 126 in order to allow a user to lift the bag if desired.

In FIG. 1, a second additional compartment is shown mounted on the outside of the closed face 18 of the upper compartment. The additional compartment 136 has a rectangular periphery 138, and an internal compartment 140 which is closed by zippers 142. Second additional compartment 136 further includes separated pockets 144 and 146 which have their own zippered openings. Finally, opposite wheels 122 are support feet 148 which are used to maintain case 10 in the upright position shown in FIG. 1.

The overall dimensions of the case 10 are about 17 inches in one direction and about 24 inches in the other direction, which makes it just small enough to fit in the overhead compartment of an airliner. The fabric used in the construction is conventional heavy artificial fabric normally employed for use in soft-sided luggage.

While the invention has been described with particular reference to a specific embodiment thereof, it will be apparent to those skilled in the art that the same principles may be used in similar arrangements. Furthermore, it will be recognized the invention is not limited to the precise structure described. Therefore, it is to be understood that although the invention has been described with particular reference to the specific preferred embodiment, the form of the invention shown and described in detail is to be taken as a preferred embodiment only, and that various changes and modifications may be resorted to without departing from the spirit and scope of the invention defined by the appended claims.

What is claimed:

1. A rigid frame garment bag and travel case combination suitable for accommodating several suits and soft garments for transport without wrinkling or creasing comprising:

a) a general rectilinear shaped case having opposed openable main compartments comprising an upper compartment and a lower compartment foldingly hinged along one common side, the compartments being defined by a closed face, an open face and three generally rectangular sides in addition to the common side, wherein the three rectangular sides of said compartments have edges which come together along a common parting line closeable with a sliding fastener when the compartments are pivoted toward each other about the foldingly hinged common side to close and form the case;

b) the three generally rectangular sides of the upper compartment comprise an upper side continuing into opposed left and right sides when viewed from above with the case open and laying flat on a surface;

c) the three generally rectangular sides of the lower compartment comprise a lower side continuing into opposed left and right sides when viewed from above with the case opened and laying flat on a surface;

d) a rigid U-shaped frame which extends across the upper side, having legs which extend along the left and right sides of the upper compartment toward but short of the common side, and at least one brace lying across the closed face of the upper compartment and connecting the legs of the rigid frame;

e) a rigid U-shaped frame which extends across the lower side having legs which extend along the left and right sides of the lower compartment toward but short of the common side, and at least one brace lying across the closed face of the lower compartment and connecting the legs of the rigid frame;

f) a foldable panel including first and second panel sections and a flexible panel section connected to and disposed intermediate the first and second panel sections but not connected to the common side, the first and second panel sections each having an edge foldably connected along one side edge of the upper and lower compartments, respectively, the foldable panel being pivotably movable from a closed position covering both the lower and upper compartments to an open position in which the lower compartment and upper compartment are uncovered, the first and second panel sections being foldable inwardly toward each other about the flexible panel section during closing movement of the lower and upper compartments toward each other and being sandwiched between the lower and upper compartments when the compartments are in the closed position;

g) a planar frame forming part of the common side between the upper and lower compartments, the common side having an upper edge portion and a lower edge portion when considered in the flat laid open orientation of the case wherein the upper edge portion serves as a loosely hinged connection to the upper main compartment and the lower edge portion serves as a loosely hinged connection to the lower main compartment and the planar frame acts as a backbone of the common side to which handles or straps may be anchored from the outside of the case, whereby a suit can be laid out flat across the upper and lower compartment and covered with the foldable panel to create a soft fold in the vicinity of the common side when the case is closed and secured thereby preventing hard wrinkles from forming.

2. The combination of claim 1 wherein the common side has an interior surface facing up when the case is open with the closed faces of the main compartments on a surface, the common side having a securable strap along the interior surface of the common side over the planar frame which can hold a suit against the common side thereby establishing a soft fold at the common side when the case is closed.

3. The combination of claim 1 further including an additional folding panel having an edge connected along the lower side of the lower compartment and an area substantially equal to the open area of the lower compartment which can be folded over in a first position covering the open face of the lower compartment and unfolded to a second position depending from the lower side wherein the open face of the lower compartment is uncovered.

4. The combination of claim 1 further including an additional compartment mounted on the closed face of the lower compartment wherein the additional compartment is substantially coextensive with the lower compartment, has a perimeter wall defined by a frame and including exposed wheels attached to the frame and a handle suitable for rolling the closed case along a surface without lifting the full weight of the case.

5. The combination of claim 4 wherein the additional compartment is traversed internally by an extendable handle mechanism connected to an extendable handle opposite the wheels and having an openable access opening for storage of soft garments within the additional compartment.

6. The combination of claim 5 further including a second additional compartment mounted on the closed face of the upper compartment wherein the additional compartment is substantially coextensive with the upper compartment, having a flexible outer wall surface accessible from the outside of the closed case for storage of soft garments.

7. The combination of claim 1 wherein the common side has an interior surface facing up when the case is open with the closed faces of the main compartments on a surface, the common side having a securable strap along the interior surface of the common side over the planar frame, which can hold a suit against the common side thereby establishing a soft fold adjacent the common side when the case is closed.

8. In a rigid frame garment bag and travel case combination of the type including rigid frame members and side members forming lower and upper compartments that are coupled to opposite side edges of a common side member, the lower and upper compartments being foldably hinged along the common side member for movement to a closed position in which the lower and upper compartments are folded together in side-by-side relation, to an open position in which the lower and upper compartments are unfolded from each other, the improvement comprising a foldable panel having first and second panel sections pivotably coupled along side edges of the lower and upper compartments, respectively, the foldable panel being pivotably movable from a closed position covering both the lower and upper compartments to an open position in which the lower compartment and upper compartment are covered, and the foldable panel including a flexible panel section connected to and disposed intermediate the first and second panel sections but not connected to the common side member wherein the first and second panel sections are foldable inwardly toward each other about the flexible panel section during closing movement of the compartments toward each other, and the first and second panel sections being sandwiched between the lower and upper compartments when the compartments are in the closed position.

* * * * *